US009972177B1

(12) United States Patent
Kashyap et al.

(10) Patent No.: US 9,972,177 B1
(45) **Date of Patent: *May 15, 2018**

(54) WIRELESS ROUTER CONFIGURED TO DETECT AN INTRUDER

(71) Applicant: SYMANTEC CORPORATION, Mountain View, CA (US)

(72) Inventors: Anand Kashyap, Pune (IN); Qiyan Wang, Mountain View, CA (US)

(73) Assignee: SYMANTEC CORPORATION, Mountain View, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/705,859

(22) Filed: Sep. 15, 2017

Related U.S. Application Data

(63) Continuation of application No. 14/222,449, filed on Mar. 21, 2014, now Pat. No. 9,786,138.

(51) Int. Cl.

| | |
|---|---|
| ***G08B 13/00*** | (2006.01) |
| ***G08B 13/24*** | (2006.01) |
| ***G08B 13/26*** | (2006.01) |
| ***G08B 13/18*** | (2006.01) |

(52) U.S. Cl.
CPC ..... *G08B 13/00* (2013.01)

(58) Field of Classification Search
CPC ..... G08B 15/001; G08B 13/183; G01S 13/04; G01S 13/56; G01S 5/0252
USPC ..... 340/541, 552, 561, 565, 567
See application file for complete search history.

(56) References Cited

U.S. PATENT DOCUMENTS

| | | | | |
|---|---|---|---|---|
| 6,624,750 | B1 * | 9/2003 | Marman | G08B 25/003 340/4.3 |
| 2004/0160306 | A1 * | 8/2004 | Stilp | G06K 7/0008 340/5.61 |
| 2008/0007404 | A1 * | 1/2008 | Albert | G01S 5/0252 340/552 |
| 2008/0079572 | A1 * | 4/2008 | Tsaba | G08B 13/18 340/552 |
| 2014/0077929 | A1 * | 3/2014 | Dumas | G07C 9/00571 340/5.61 |
| 2015/0163240 | A1 * | 6/2015 | Geigel | H04L 63/1441 726/23 |
| 2016/0178741 | A1 * | 6/2016 | Ludlow | G01S 7/003 342/28 |

* cited by examiner

*Primary Examiner* — Emily C Terrell
(74) *Attorney, Agent, or Firm* — Maschoff Brennan

(57) ABSTRACT

A wireless router configured to detect an intruder. In one embodiment, a method may include monitoring received signal strength in a wireless router and creating a profile of the received signal strength as monitored during a learn mode. The method may also include comparing activity of the received signal strength in the wireless router, during an intruder detection mode, to the profile and issuing a notification, based on the comparing.

20 Claims, 5 Drawing Sheets

WIRELESS ROUTER CONFIGURED TO DETECT AN INTRUDER

CROSS-REFERENCE TO A RELATED APPLICATION

This application is a continuation of U.S. patent application Ser. No. 14/222,449, filed Mar. 21, 2014, which is incorporated herein by reference in its entirety.

BACKGROUND

Intruder detection systems often require installation of specialized equipment and wiring, including various sensors and power supplies. Sensors for intruder detection systems generally fall into two major categories. A first category is hardwired sensors, such as window switches, door switches and floor pads. A second category is area-based noncontact sensors, such as ultrasound transceivers and infrared detectors. Each category of sensors has advantages and disadvantages. The installation process for an intruder detection system may be expensive to a user and disruptive to the home or business environment. Further, professional burglars may be able to defeat known, familiar sensor and wiring installations.

It is within this context that the embodiments arise.

SUMMARY

In some embodiments, a method for detecting an intruder is provided. The method includes monitoring received signal strength in a wireless router and creating a profile of the received signal strength as monitored during a learn mode. The method includes comparing activity of the received signal strength in the wireless router, during an intruder detection mode, to the profile and issuing a notification, based on the comparing, wherein at least one step of the method is performed by a processor.

In some embodiments, a tangible, non-transitory, computer-readable media having instructions thereupon which, when executed by a processor, cause the processor to perform a method is provided. The method includes forming an activity profile based on a signal strength as indicated by a wireless router, in a training mode and monitoring the signal strength in an intruder detection mode. The method includes detecting a physical intruder, based on the activity profile and the monitoring in the intruder detection mode and producing an alert, responsive to the detecting.

In some embodiments, an intruder detection system is provided. The system includes a wireless router, configured to indicate a received signal strength, a memory, configured to store at least one profile and an alert module, configured to issue a notification responsive to being triggered. The system includes an analytics module, configured to generate or update the at least one profile, based on the received signal strength as monitored during a learn mode, and further configured to trigger the alert module responsive to detection of an intruder based on comparison of the at least one profile and an activity of the received signal strength during an intruder detection mode.

Other aspects and advantages of the embodiments will become apparent from the following detailed description taken in conjunction with the accompanying drawings which illustrate, by way of example, the principles of the described embodiments.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

An intruder detection system and related method are herein described. The intruder detection system makes use of a wireless router, specially configured to monitor activity of received signal strength. The system develops a profile of such signal strength activity, and compares activity of the received signal strength to the profile, during an intruder detection mode. In some embodiments, the profile is built from wireless signals emitted by several devices typically present in the environment. When the activity of the received signal strength deviates from the profile, the system generates an alert, which can be in the form of a posting to a server, a text message sent to a user device, a notification to an agency, or other alarm. Training, indication of a false alarm, and further learning are applied by the system to modify the profile, so that accuracy of intruder detection is improved.

Figure 1:
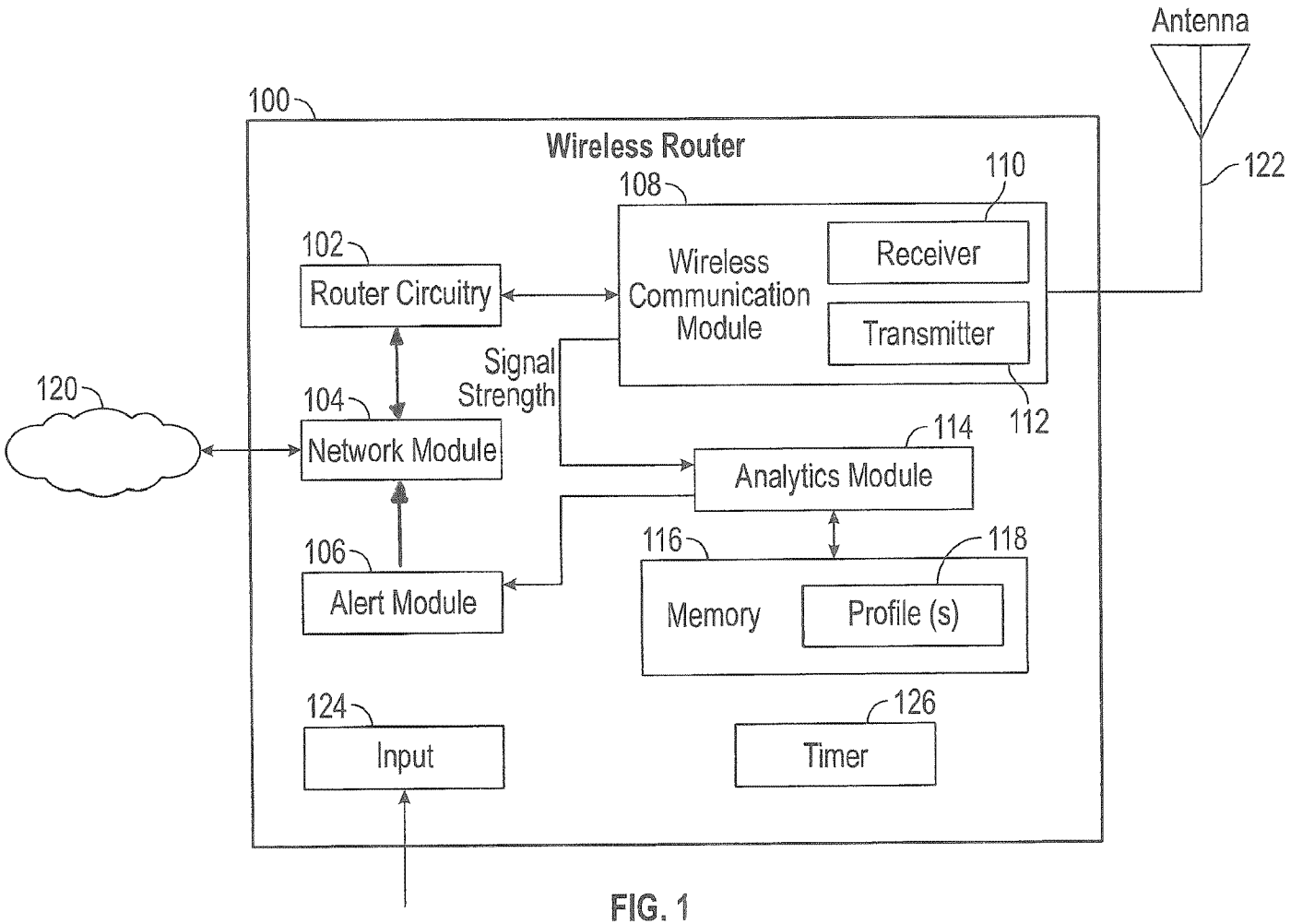
FIG. 1 is a system diagram of a wireless router configured for intruder detection, in accordance with some embodiments.

FIG. 1 is a system diagram of a wireless router 100 configured for intruder detection, in accordance with an embodiment of the present disclosure. Embodiments of the wireless router 100 can be created by adding programming and/or specialized components to a standard wireless router, as used in a home or business to wirelessly route a coupling to a network 120, or can be created by implementing a wireless router with specialized programming and/or components anew. A network module 104 of the wireless router 100 couples to a network, such as a local area network (LAN) or a global communication network such as the Internet, through well-established and understood mechanisms. Router circuitry 102 of the wireless router 100 manages the network module 104 and the wireless communication module 108. Among other tasks, the router circuitry 102, the network module 104, and the wireless communication module 108 handle the wireless routing of data to and from any wireless devices that couple to the wireless router 100, similarly to a standard wireless router. The wireless communication module 108 includes a receiver 110 and a transmitter 112, or a transceiver, etc. The receiver 110 and transmitter 112 are coupled to an antenna 122, which is used to wirelessly transmit and receive, as is well-known for other wireless routers. The wireless communication module 108 produces a signal strength indicator, which indicates the received signal strength as seen by the receiver 110. For example, the industry standard RSSI (received signal strength indicator) or the industry standard RCPI (received channel power indicator), or other indication of signal strength, could be used, or another signal, data or device could be applied.

Still referring to FIG. 1, the signal strength indicator is applied to an analytics module 114 of the wireless router 100. The analytics module 114 monitors the signal strength of the received wireless signal. During a learning mode or training mode, the analytics module 114 generates or modifies one or more profiles 118, which are stored in the memory 116. In some embodiments, the profile is built from wireless signals emitted by several devices typically present in the environment. The analytics module 114 then looks for inconsistencies in the signal strength of the received wireless signal as compared to the profiles 118. Portions, or the entirety of the analytics module 114, could be implemented as software executing on a processor, which could be a processor that is further used in other aspects of the wireless router 100, or could be a processor dedicated to the analytics functions. Portions of the analytics module 114 could be implemented in hardware, firmware, software, or combinations thereof. It should be appreciated that a processor may refer to a programmable logic device or a microprocessor in some embodiments.

When the analytics module 114 detects an intruder, as will be further described below with reference to FIG. 2, the analytics module triggers the alert module 106 of the wireless router 100. The alert module 106 then issues a notification. The notification could be in the form of lighting a lamp, issuing an alarm sound, or sending a message or other notification out via the network module 104 to the network 120, e.g., to a destination device or agency as will be further discussed with reference to FIG. 3. Some embodiments of the wireless router 100 have one or more input devices 124, such as buttons, switches, a touchscreen, an input port and so on. An input device 124, in such embodiments, can be used to activate learn mode, deactivate learn mode, activate intruder detection mode, deactivate intruder detection mode, initiate a delayed activation of intruder detection mode, and/or perform, initiate or terminate other functions in response to a user request.

Some embodiments of the wireless router 100 of FIG. 1 include a timer 126. The timer 126 is applied to timing intervals while monitoring the received signal strength. The timer could thus be applied during a training or learning mode, in order to gauge time lengths and apply these to the profiles 118. The timer 126 could be applied during intruder detection mode, in order to gauge a time length of an activity of the received signal strength, for comparison with the profiles 118. Or, the timer 126 could be applied to starting and stopping, e.g., scheduling, the intruder detection mode, or any of the other modes.

Figure 2A:
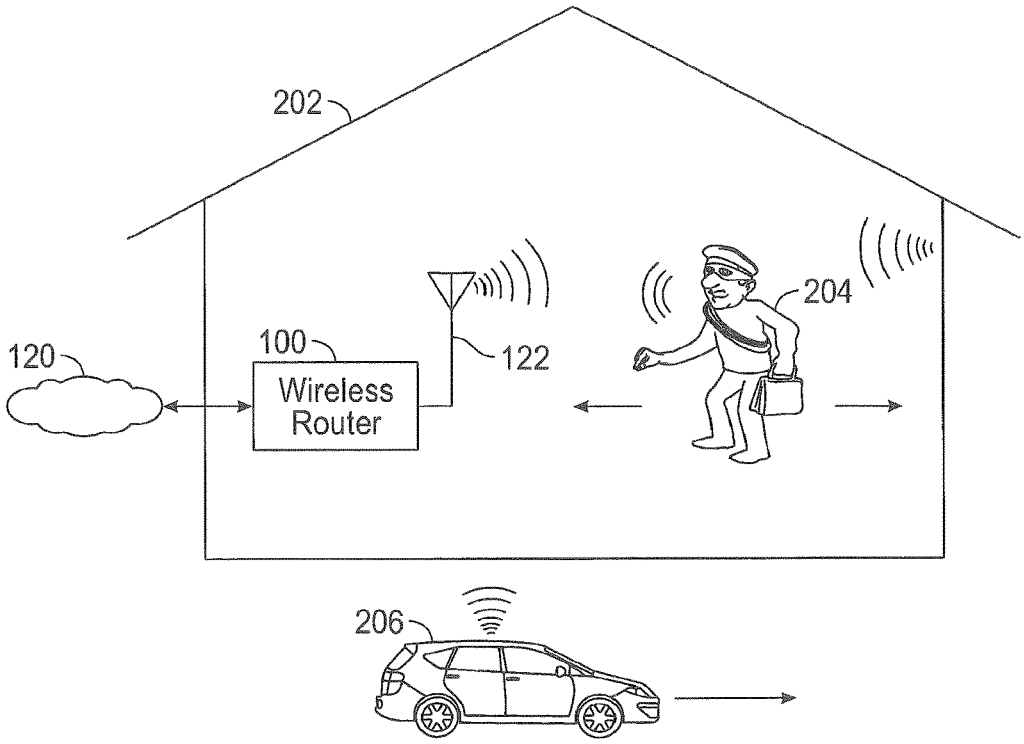
FIG. 2A is a scenario diagram, showing the wireless router of FIG. 1 detecting an intruder in a house or business in accordance with some embodiments.

FIG. 2A is a scenario diagram, showing the wireless router 100 of FIG. 1 detecting an intruder 204 in a house 202 or business, or other locale. A distinction is herein made between detecting a physical intruder 204, versus detecting an electronic intruder such as a hacker, which can be addressed by other systems. Here, the wireless router 100 is operating in a monitoring mode, passively listening to wireless traffic such as Wi-Fi (wireless fidelity). The wireless router 100 can receive Wi-Fi packets in this mode, and record received signal strength values. In this manner, the wireless router 100 can build a radio frequency (RF) profile of the local environment over a period of time. In some embodiments, the profile is built from wireless signals emitted by several devices typically present in the environment. Typically the RF profile for a wireless router 100 is stable unless there is a change in the radio environment. The radio environment could change during a period of observation as a result of a Wi-Fi device being mobile, thus causing a change in signal strength. This could happen when a person walks while speaking on a cell phone, or enters or leaves the house while speaking on the cell phone. Alternatively, there could be a change in the local environment which affects the received signal strength of stationary devices. Such a change in environment could be caused by predictable or unpredictable reasons. An example of a predictable change is a microwave oven being turned on. Such predictable changes can be observed and modeled. An unpredictable change in the radio environment of the wireless router 100, i.e., a change in the RF profile, could indicate a possible home intrusion, i.e., presence of an intruder 204.

In the example of operation of the wireless router 100 shown in FIG. 2A, the intruder 204 is moving (indicated by arrows to either side of the intruder 204), which changes the RF environment in the house 202, particularly in the vicinity of, and as detected by, the antenna 122 of the wireless router 100. Changes in the RF environment can include changes in reflected signals from either the intruder 204 or walls of the house 202, for example by the intruder 204 blocking reflected signals or changing the paths of reflected signals. An automobile 206 driving past the house 202 could also create changes in the RF environment, which should be viewed as a false alarm. The wireless router 100, and more specifically the analytics module 114, can develop the profile or profiles 118 during a learn mode or training mode over a specified span of time. If there is a false alarm, such as when activity of the received signal strength falls outside the profile during an intruder detection mode but a user later indicates this was a false alarm, the analytics module 114 can update or modify the profile 118 based on the new learning. For example, a user could receive a notification to a cell phone, and send back a command or message that this is a false alarm, as the user recalls that relatives or friends are visiting. Or, the user could review a history, and indicate that certain events were false alarms, e.g. via a graphical user interface (GUI). In addition, the wireless router 100 could monitor activity of the received signal strength when not in training mode and not in intruder detection mode, and learn about various events and patterns of activity such as the automobile 206 driving by, people walking past the house, or pets etc. A user could invoke training mode, and walk around inside the house 202 so that the analytics module 114 can develop a profile 118 indicative of a human moving within a detection zone of the wireless router 100. A profile 118 developed from such training could include a time-based profile of a range of activity of the received signal strength in some embodiments. The profile 118 thus establishes a threshold for detection of human presence within the detection zone.

Figure 2B:
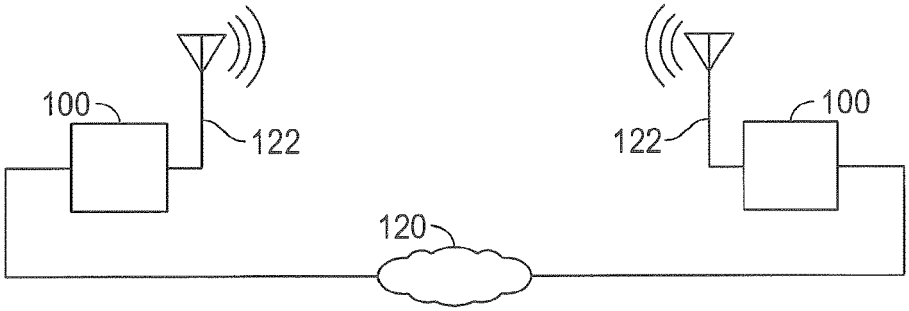
FIG. 2B is a scenario diagram, showing the wireless router of FIG. 1 cooperating with a further wireless router in accordance with some embodiments.

FIG. 2B is a scenario diagram, showing the wireless router 100 of FIG. 1 cooperating with a further wireless router 100. In this scenario, the specially configured wireless router 100 is coupled through a network 120 to the further wireless router 100, and the wireless routers 100 share information. For example, the wireless routers 100 could share information about possible intruder detections, or information about profiles 118. Moreover, each wireless router 100 could detect received signal strength based on the transmission from the opposed wireless router 100. One wireless router 100 could send a request to the other wireless router 100 for a specific transmission, or the routers 100 could agree to transmissions at certain times, and so on. In some embodiments, training for the wireless router 100 would include such situations where applicable, especially in training to detect a human presence.

Figure 3:
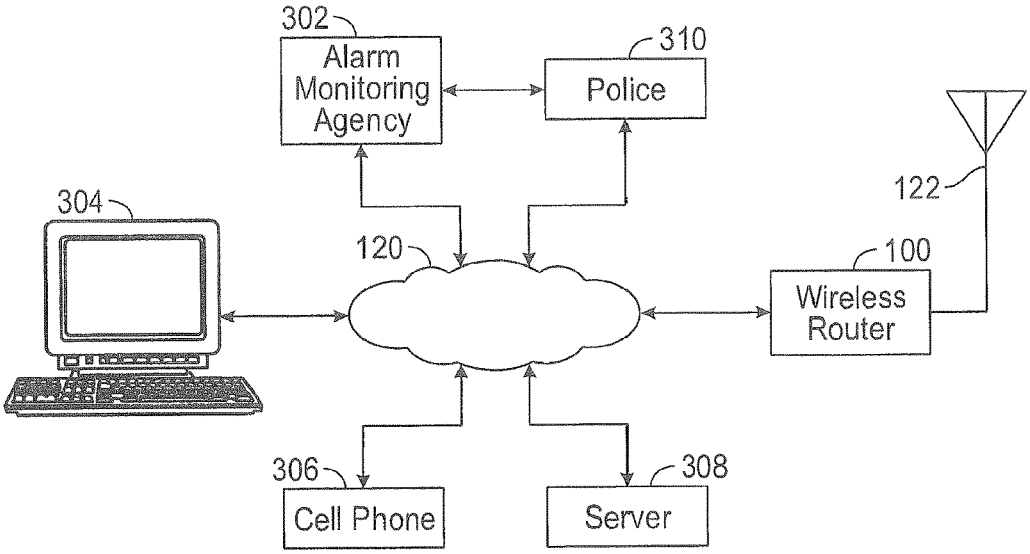
FIG. 3 is a system diagram, showing the wireless router of FIG. 1 coupled to a network and various devices in accordance with some embodiments.

FIG. 3 is a system diagram, showing the wireless router 100 of FIG. 1 coupled to a network 120 and various devices 304, 306, 308. As discussed above, the wireless router 100, and more specifically the alert module 106, could send a notification out via the network module 104 to the network 120. The notification could have an address of a server 308, so that the notification can be posted on the server 308. In some embodiments, the server 308 could act on receiving such a notification, and send a text message to a cell phone 306, an email to a computing device 304, a text message, a digitized or synthesized voice message, a document or other notification to an alarm monitoring agency 302 or the police 310, or otherwise send alerts or notifications. In some embodiments, the wireless router 100 can send such notifications directly to the cell phone 306, the computing device 304, the alarm monitoring agency 302 or police 310, or elsewhere. In some embodiments, a user could couple to the server 308, using a cell phone 306 via the network 120, in order to receive or check for an intruder alert per the notification from the alert module 106. For example, the alert module 106 could send a notification to the server 308, via the network 120. The server 308 could then send a text message via the network 120 to the cell phone 306. A user of the cell phone 306 could then couple via the network 120 to the server 308, to verify or obtain further details about the notification. In further examples, the server 308 or the wireless router 100 could broadcast the notification to multiple destinations.

Figure 4:
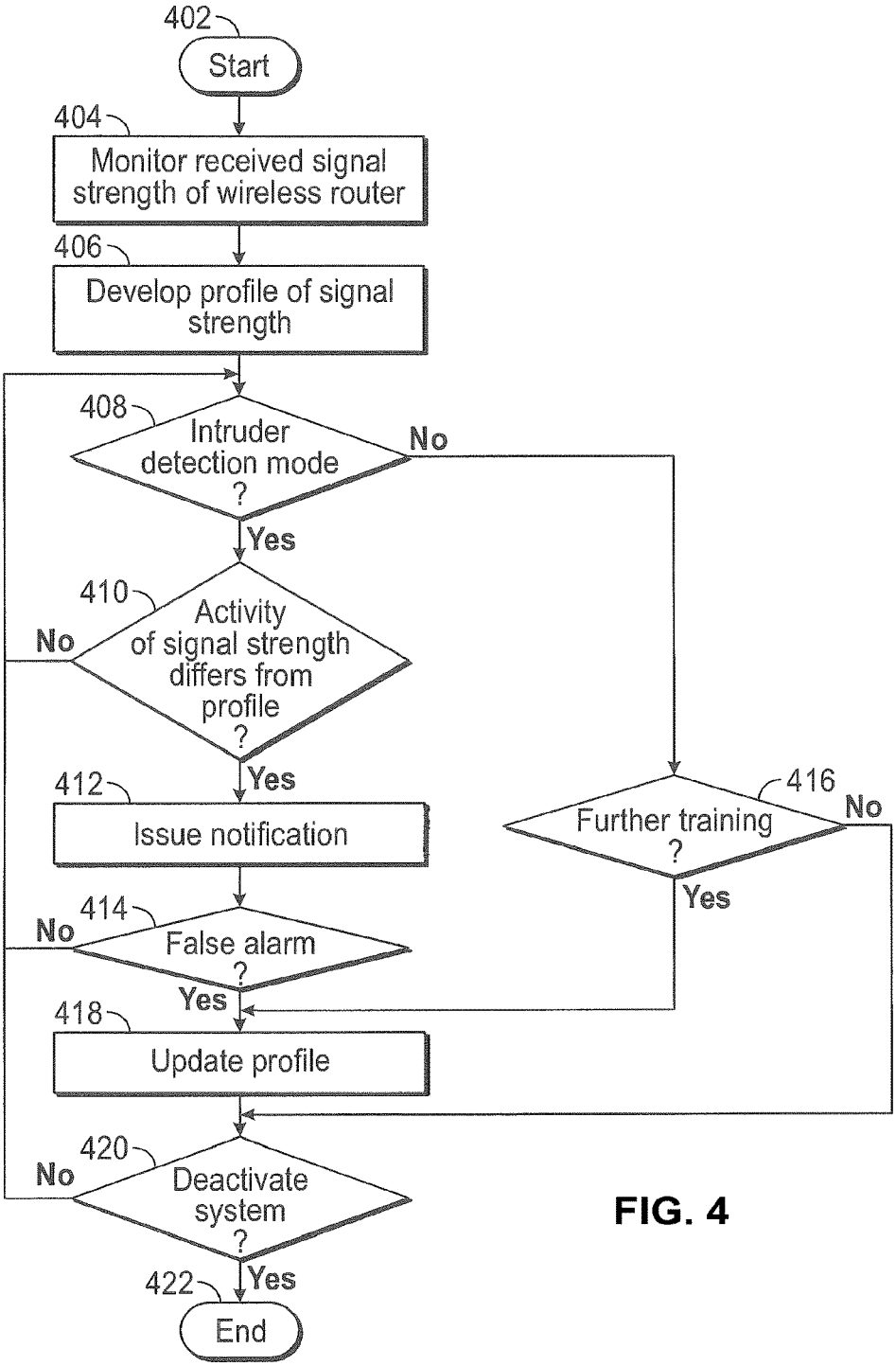
FIG. 4 is a flow diagram, showing a method of detecting an intruder, which can be practiced on embodiments of the specially configured wireless router of FIG. 1 in accordance with some embodiments.

FIG. 4 is a flow diagram, showing a method of detecting an intruder, which can be practiced on embodiments of the specially configured wireless router 100 of FIG. 1. Many or all of the actions of the flow diagram in FIG. 4 can be performed by or using a processor, such as a processor in the wireless router 100 or a processor coupled to the wireless router 100. Variations and further embodiments of the depicted method are readily devised in accordance with the teachings disclosed herein. The method could be embodied on a tangible, non-transient, computer-readable media.

From a start point 402, the received signal strength of the wireless router is monitored, in an action 404. For example, strength of a signal received via the antenna and the wireless communication module could be monitored by the analytics module. Such monitoring can be applied during a training mode, a learn mode, an intruder detection mode, a further learning mode, an update mode and so on. In an action 406, a profile of the signal strength is developed. This could be developed during a training mode or learn mode. In some embodiments, a profile could be developed and installed in the memory 116, e.g., as an initial profile generic to a batch or a product line prior to shipping the wireless router 100, and the profile could then be updated at a home or business, i.e., personalized, where the wireless router 100 is installed. In some embodiments, the profile is built from wireless signals emitted by several devices typically present in the environment.

In a decision action 408 of FIG. 4, a question is asked, is the wireless router 100 in intruder detection mode? For example, the intruder detection mode could be activated via communication through the network module, or via an input device. If the answer is no, flow proceeds to the decision action 416. If the answer is yes, flow proceeds to the decision action 410. In the decision action 410, with the system in intruder detection mode, a question is asked, does the activity of the signal strength differ from the profile? If the answer is no, flow branches back to the decision action 408, in order to see if the system is still in intruder detection mode, for ongoing monitoring. If the answer is yes, flow branches to the action 412. In the action 412, a notification is issued. This notification serves as an alarm, and could take any or all of the forms discussed above with reference to FIGS. 1 and 2. For example, the notification could include posting to a server, or sending a message to a user or an agency.

In an action 414 of FIG. 4, a question is asked, is there a false alarm? If the answer is no, flow branches back to the decision action 408, in order to see if the system is still in intruder detection mode, for ongoing monitoring and proceeds as described above. If the answer is yes, flow branches to the action 418. In the decision action 416, which is arrived at because the system is not in intruder detection mode, a question is asked, should there be further training? If the answer is no, flow branches to the decision action 420. If the answer is yes, flow branches to the action 418. In the action 418, which is arrived at because there was a false alarm or further training is indicated, the profile is updated. For example, the profile could be updated during a further learn mode or training mode, or could be updated with the information from the false alarm. In the decision action 420, a question is asked, should the system be deactivated? The system could be deactivated by a communication through the network module, or via an input device. If the answer is no, the system should not be deactivated, the flow branches back to the decision action 408 in order to see if the system is in intruder detection mode. If the answer is yes, the system should be deactivated, flow branches to the endpoint 422.

Figure 5:
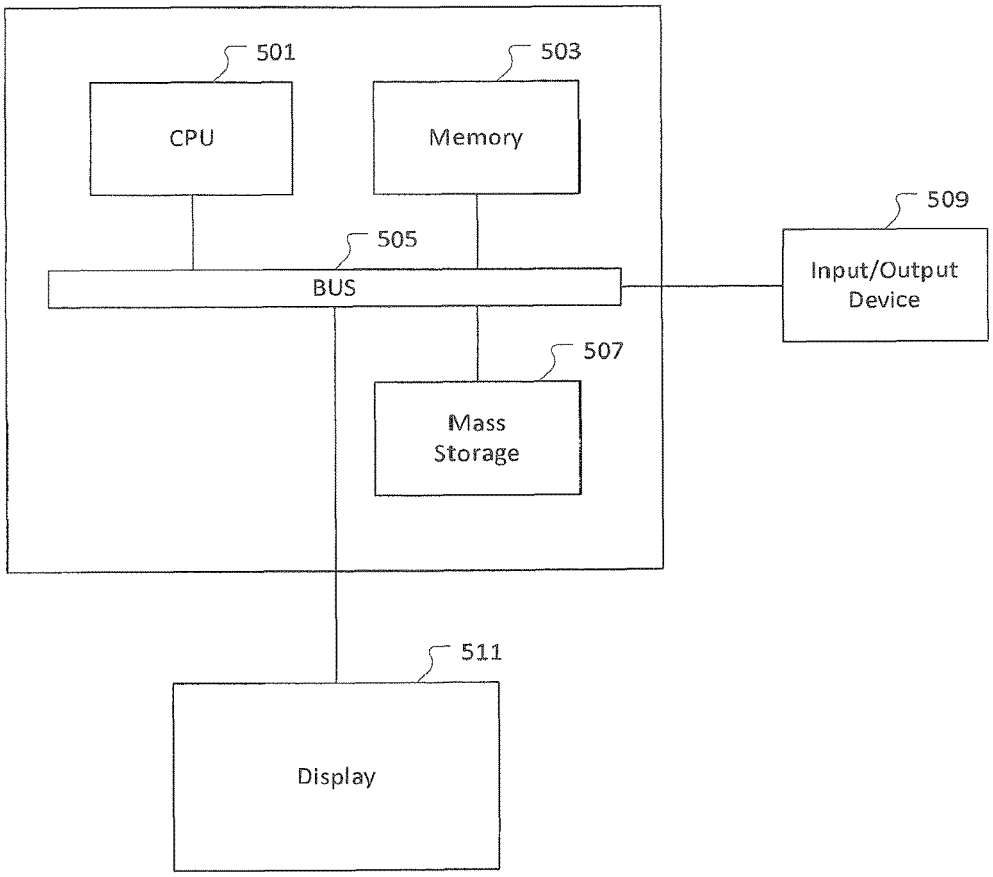
FIG. 5 is an illustration showing an exemplary computing device which may implement the embodiments described herein.

It should be appreciated that the methods described herein may be performed with a digital processing system, such as a conventional, general-purpose computer system. Special purpose computers, which are designed or programmed to perform only one function may be used in the alternative. FIG. 5 is an illustration showing an exemplary computing device which may implement the embodiments described herein. The computing device of FIG. 5 may be used to perform embodiments of the functionality for analytics, alerts, signal strength monitoring, profile development and modification, and other functions in accordance with some embodiments. The computing device includes a central processing unit (CPU) 501, which is coupled through a bus 505 to a memory 503, and mass storage device 507. Mass storage device 507 represents a persistent data storage device such as a floppy disc drive or a fixed disc drive, which may be local or remote in some embodiments. The mass storage device 507 could implement a backup storage, in some embodiments. Memory 503 may include read only memory, random access memory, etc. Applications resident on the computing device may be stored on or accessed via a computer readable medium such as memory 503 or mass storage device 507 in some embodiments. Applications may also be in the form of modulated electronic signals accessed via a network modem or other network interface of the computing device. It should be appreciated that CPU 501 may be embodied in a general-purpose processor, a special purpose processor, or a specially programmed logic device in some embodiments.

Display 511 is in communication with CPU 501, memory 503, and mass storage device 507, through bus 505. Display 511 is configured to display any visualization tools or reports associated with the system described herein. Input/output device 509 is coupled to bus 505 in order to communicate information in command selections to CPU 501. It should be appreciated that data to and from external devices may be communicated through the input/output device 509. CPU 501 can be defined to execute the functionality described herein to enable the functionality described with reference to FIGS. 1-4. The code embodying this functionality may be stored within memory 503 or mass storage device 507 for execution by a processor such as CPU 501 in some embodiments. The operating system on the computing device may be MS DOS™, MS-WINDOWS™, OS/2™, UNIX™, LINUX™, or other known operating systems. It should be appreciated that the embodiments described herein may be integrated with virtualized computing systems also.

Detailed illustrative embodiments are disclosed herein. However, specific functional details disclosed herein are merely representative for purposes of describing embodiments. Embodiments may, however, be embodied in many alternate forms and should not be construed as limited to only the embodiments set forth herein.

It should be understood that although the terms first, second, etc. may be used herein to describe various steps or calculations, these steps or calculations should not be limited by these terms. These terms are only used to distinguish one step or calculation from another. For example, a first calculation could be termed a second calculation, and, similarly, a second step could be termed a first step, without departing from the scope of this disclosure. As used herein, the term "and/or" and the "I" symbol includes any and all combinations of one or more of the associated listed items.

As used herein, the singular forms "a", "an" and "the" are intended to include the plural forms as well, unless the context clearly indicates otherwise. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof. Therefore, the terminology used herein is for the purpose of describing particular embodiments only and is not intended to be limiting.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

With the above embodiments in mind, it should be understood that the embodiments might employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing. Any of the operations described herein that form part of the embodiments are useful machine operations. The embodiments also relate to a device or an apparatus for performing these operations. The apparatus can be specially constructed for the required purpose, or the apparatus can be a general-purpose computer selectively activated or configured by a computer program stored in the computer. In particular, various general-purpose machines can be used with computer programs written in accordance with the teachings herein, or it may be more convenient to construct a more specialized apparatus to perform the required operations.

A module, an application, a layer, an agent or other method-operable entity could be implemented as hardware, firmware, or a processor executing software, or combinations thereof. It should be appreciated that, where a software-based embodiment is disclosed herein, the software can be embodied in a physical machine such as a controller. For example, a controller could include a first module and a second module. A controller could be configured to perform various actions, e.g., of a method, an application, a layer or an agent.

The embodiments can also be embodied as computer readable code on a computer readable medium. The computer readable medium is any data storage device that can store data, which can be thereafter read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer system so that the computer readable code is stored and executed in a distributed fashion. Embodiments described herein may be practiced with various computer system configurations including hand-held devices, tablets, microprocessor systems, microprocessor-based or programmable consumer electronics, minicomputers, mainframe computers and the like. The embodiments can also be practiced in distributed computing environments where tasks are performed by remote processing devices that are linked through a wire-based or wireless network.

Although the method operations were described in a specific order, it should be understood that other operations may be performed in between described operations, described operations may be adjusted so that they occur at slightly different times or the described operations may be distributed in a system which allows the occurrence of the processing operations at various intervals associated with the processing.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the embodiments and its practical applications, to thereby enable others skilled in the art to best utilize the embodiments and various modifications as may be suited to the particular use contemplated. Accordingly, the present embodiments are to be considered as illustrative and not restrictive, and the invention is not to be limited to the details given herein, but may be modified within the scope and equivalents of the appended claims.

The invention claimed is:

1. A computer-implemented method for detecting an intruder, at least a portion of the method being performed by a computing device comprising at least one processor, the method comprising:

monitoring received signal strength in a wireless router from wireless devices during a training mode;

creating a profile of the received signal strength as monitored during the training mode, the profile comprising at least one time-based range of activity of the received signal strength during the training mode;

monitoring received signal strength in the wireless router from wireless devices during an intruder detection mode;

determining whether the received signal strength as monitored during the intruder detection mode deviates from the profile; and in response to determining that the received signal strength as monitored during the intruder detection mode deviates from the profile, issuing a notification that an intruder has been detected.

2. The method of claim 1, further comprising:

determining that the detection is a false alarm of an intrusion; and updating the profile in response to the false alarm of the intrusion.

3. The method of claim 1, wherein the profile is created by updating an initial profile that is generic to a plurality of wireless routers.

4. The method of claim 1, further comprising:

starting the training mode in response to a request from a user; and starting the intruder detection mode in response to a further request from a user.

5. The method of claim 1, wherein the training mode comprises training by a user.

6. The method of claim 1, further comprising:

updating the profile when not in the intruder detection mode.

7. The method of claim 1, wherein the issuing of the notification comprises posting the notification to a server, sending the notification in a text message to a user device, or sending the notification to an alarm monitoring agency.

8. One or more non-transitory computer-readable media comprising one or more computer-readable instructions that, when executed by one or more processors of one or more computing devices, cause the one or more computing devices to perform a method for detecting an intruder, the method comprising:

monitoring received signal strength in a wireless router from wireless devices during a training mode;

creating a profile of the received signal strength as monitored during the training mode, the profile comprising at least one time-based range of activity of the received signal strength during the training mode;

monitoring received signal strength in the wireless router from wireless devices during an intruder detection mode;

determining whether the received signal strength as monitored during the intruder detection mode deviates from the profile; and in response to determining that the received signal strength as monitored during the intruder detection mode deviates from the profile, issuing a notification that an intruder has been detected.

9. The one or more non-transitory computer-readable media of claim 8, wherein the method further comprises:

determining that the detection is a false alarm of an intrusion; and updating the profile in response to the false alarm of the intrusion.

10. The one or more non-transitory computer-readable media of claim 8, wherein the profile establishes a threshold for detection of human presence within a detection zone of the wireless router.

11. The one or more non-transitory computer-readable media of claim 8, wherein:

the wireless router is configured to receive a wireless signal transmitted from a second wireless router; and the profile further comprises information shared by the second wireless router over the wireless signal received from the second wireless router.

12. The one or more non-transitory computer-readable media of claim 8, wherein the profile is created by updating an initial profile that is generic to a plurality of wireless routers.

13. The one or more non-transitory computer-readable media of claim 8, wherein the method further comprises:

updating the profile to comprise patterns of activity of the received signal strength outside of the training mode and the intruder detection mode.

14. A wireless router comprising:

a receiver configured to receive wireless signals from wireless devices;

one or more processors;

one or more non-transitory computer-readable media comprising one or more computer-readable instructions that, when executed by the one or more processors, cause the one or more processors to perform a method for detecting an intruder, the method comprising:

monitoring received signal strength of the received wireless signals during a training mode;

creating a profile of the received signal strength as monitored during the training mode, the profile comprising at least one time-based range of activity of the received signal strength during the training mode;

monitoring received signal strength of the received wireless signals during an intruder detection mode;

determining whether the received signal strength as monitored during the intruder detection mode deviates from the profile; and in response to determining that the received signal strength as monitored during the intruder detection mode deviates from the profile, issuing a notification that an intruder has been detected.

15. The wireless router of claim 14, wherein the issuing of the notification comprises posting the notification to a server, sending the notification in a text message to a user device, or sending the notification to an alarm monitoring agency.

16. The wireless router of claim 14, further comprising:

a timer configured to apply timing intervals during the monitoring of the received signal strength in order to gauge time lengths and apply the time lengths to the profile.

17. The wireless router of claim 14, further comprising:

a transmitter configured to transmit a wireless signal to a second wireless router, the wireless signal comprising information regarding the detection of the intruder to be shared with the second wireless router.

18. The wireless router of claim 17, wherein the transmitter is further configured to wirelessly couple to a server in order to transmit the notification to the server.

19. The wireless router of claim 14, wherein the method further comprises:

determining that the detection is a false alarm of an intrusion; and updating the profile in response to the false alarm of the intrusion.

20. The wireless router of claim 14, wherein the method further comprises:

modifying the profile responsive to at least one of a false alarm, training, and activity of the received signal strength in a mode separate from the training mode and the intruder detection mode.

* * * * *